US005494085A

United States Patent [19]

Zink

[11] Patent Number: 5,494,085

[45] Date of Patent: Feb. 27, 1996

[54] CONTAINER FILLING APPARATUS

[76] Inventor: Arden K. Zink, P.O. Box 435, Louisville, Nebr. 68037

[21] Appl. No.: 389,717

[22] Filed: Feb. 16, 1995

[51] Int. Cl.[6] ..... B65B 3/00

[52] U.S. Cl. ..... 141/134; 141/135; 141/270; 141/283; 141/131

[58] Field of Search ..... 141/129, 131, 141/132, 134, 135, 183, 190, 191, 234, 236, 237, 270, 283

[56] References Cited

U.S. PATENT DOCUMENTS

| | | | |
|---|---|---|---|
| 1,260,636 | 3/1918 | Campbell | 141/131 |
| 2,631,768 | 3/1953 | Martin et al. | 141/134 |
| 2,827,928 | 3/1958 | Guckel | 141/134 |
| 3,072,303 | 1/1963 | Monk | 222/185 |
| 3,336,956 | 8/1967 | Thorn et al. | 141/134 X |
| 3,442,304 | 5/1969 | Guckel et al. | 141/134 |
| 3,713,465 | 1/1973 | van Nobelen | 141/134 |
| 3,718,164 | 2/1973 | Stewart | 141/129 X |
| 3,797,536 | 3/1974 | Pinto et al. | 141/134 |
| 4,491,159 | 1/1985 | Colacci | 141/134 |
| 4,877,067 | 10/1989 | Shimokawa et al. | 141/129 |
| 4,884,599 | 12/1989 | Mewman et al. | 141/1 |
| 4,899,790 | 2/1990 | Odenthal | 141/134 |
| 5,400,836 | 3/1995 | Divall | 141/131 X |

*Primary Examiner*—J. Casimer Jacyna
*Attorney, Agent, or Firm*—Zarley, McKee, Thomte, Voorhees & Sease; Mark D. Fredriksen

[57] ABSTRACT

A container filling apparatus includes a tank mounted over a conveyor, and containers being moved along a conveyor under the tank. An elongated slot is formed in the bottom of the tank and aligned over the containers on the conveyor, to dispense fluid into the containers. A continuous loop belt extends around a pair of drums, with a lower portion of the belt in sealed slidable engagement with the tank bottom, to cover the slot. The belt has a plurality of apertures extending uniformly around the entirety of the belt, spaced apart a distance equal to the spacing of the containers on the conveyor, such that fluid dispensed through the belt apertures sliding over the slot will fill a container below the tank. Preferably, the belt is driven by the same drive system which drives the conveyor, to synchronize the speed of movement of the belt with the speed of movement of the containers under the tank. A metering plate is operably mounted within the tank and moves between a position covering all of the apertures to thereby prevent dispensing of fluid, and a second position uncovering the apertures to permit fluid flow. The metering plate is preferably adjustable to permit adjustment of the amount of apertures covered by the plate, to thereby restrict the amount of fluid flow through the apertures.

7 Claims, 5 Drawing Sheets

CONTAINER FILLING APPARATUS

TECHNICAL FIELD

The present invention relates generally to apparatus for dispensing products into cans or the like, and more particularly to an improved container filling apparatus capable of dispensing accurate amounts of product into a container at a high rate of speed.

BACKGROUND OF THE INVENTION

Canning operations have been increasing in speed and volume over the years, and typically involve many different methods for dispensing a product within cans, jars, or other containers. In particular, canned food such as soup, often fill a container in a two-step operation, with high viscosity concentrate being first dispensed within the container, and then "topping off" the container with broth or water, prior to sealing the container. Most prior art machines utilized to dispense product into containers are relatively complicated, and costly to purchase and operate. Because liquid which spills over the sides of a container may not be reused, it is desirable to direct fluids directly into the containers without any overflow.

Typical prior art container filling apparatus are all so difficult to easily clean and maintain. It is often necessary to shut down an entire line of equipment in order to conduct minor maintenance on the machines.

SUMMARY OF THE INVENTION

It is therefore a general object of the present invention to provide an improved container filling system.

Yet another object is to provide a container filling system which overcomes the problems of the prior art as related to the food packaging industry.

Yet another object is to provide a container filling system which directs product directly into a container as it moves along a conveyor.

Still a further object of the present invention is to provide a container filling system which may be easily and quickly cleaned and repaired.

A further object is to provide a container filling system which is economical to manufacture, with few moving parts, and which permits metering of the flow of product into a container.

A further object of the present invention is to provide a container filling system which will cease the filling operation immediately in the event that the movement of containers along the conveyor is stopped.

These and other objects will be apparent to those skilled in the art.

The container filling apparatus of the present invention includes a tank mounted over a conveyor, and containers being moved along a conveyor under the tank. An elongated slot is formed in the bottom of the tank and aligned over the containers on the conveyor, to dispense fluid into the containers. A continuous loop belt extends around a pair of drums, with a lower portion of the belt in sealed slidable engagement with the tank bottom, to cover the slot. The belt has a plurality of apertures extending uniformly around the entirety of the belt, spaced apart a distance equal to the spacing of the containers on the conveyor, such that fluid dispensed through the belt apertures sliding over the slot will fill a container below the tank. Preferably, the belt is driven by the same drive system which drives the conveyor, to synchronize the speed of movement of the belt with the speed of movement of the containers under the tank. A metering plate is operably mounted within the tank and moves between a position covering all of the apertures to thereby prevent dispensing of fluid, and a second position uncovering the apertures to permit fluid flow. The metering plate is preferably adjustable to permit adjustment of the amount of apertures covered by the plate, to thereby restrict the amount of fluid flow through the apertures.

DESCRIPTION OF THE PREFERRED EMBODIMENT

Figure 1:
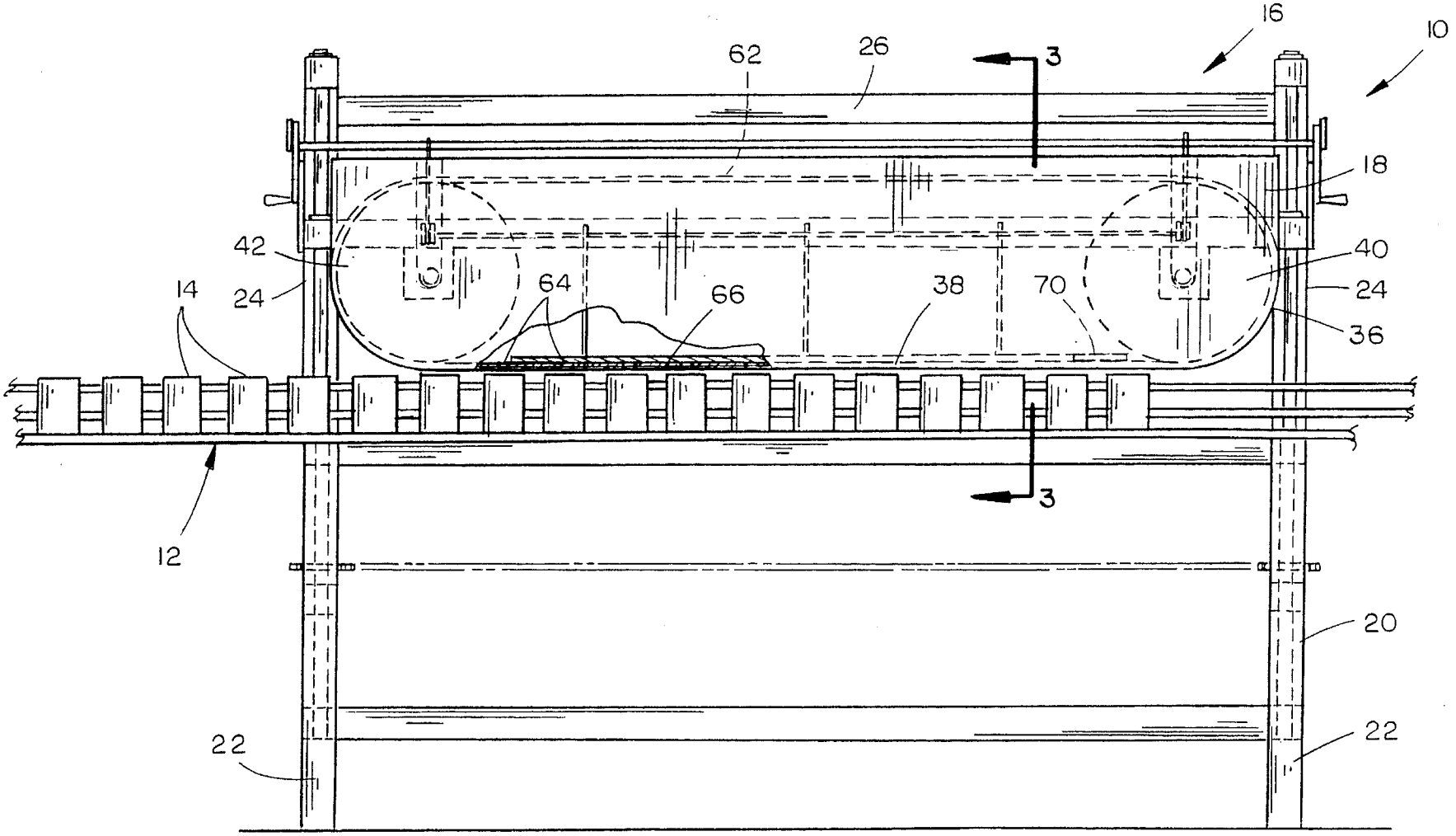
FIG. 1 is a front elevational view of the container filling system of the present invention installed on an automated food packaging conveyor.

Referring now to the drawings, in which the same or similar parts are identified with the same reference numeral, and more particularly to FIG. 1, the container filling system of the present invention is designated generally at 10 and is shown installed over a conveyor 12 moving a plurality of containers 14 at a uniform pace in a packaging line.

Figure 3:
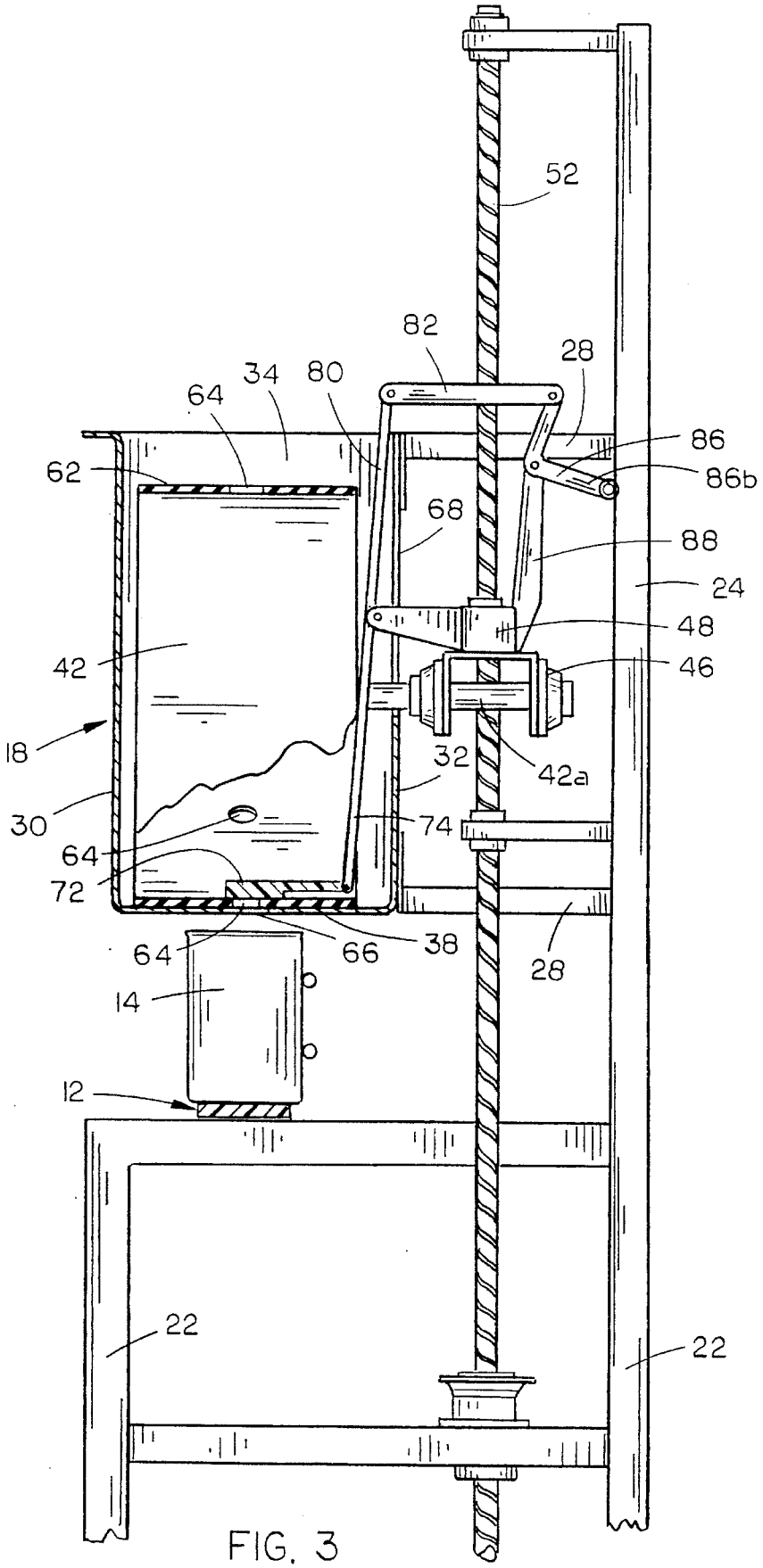
FIG. 3 is a sectional view taken at lines 3—3 in FIG. 1.

Container filling apparatus 10 includes a dispensing apparatus, designated generally at 16, installed within a reservoir or tank 18, which is supported above the conveyor 12 by a frame 20. As shown in FIGS. 1 and 3, frame 20 includes a plurality of legs 22, and a pair of upwardly projecting posts 24 connected by a cross-member 26 at their upper ends.

Figure 2:
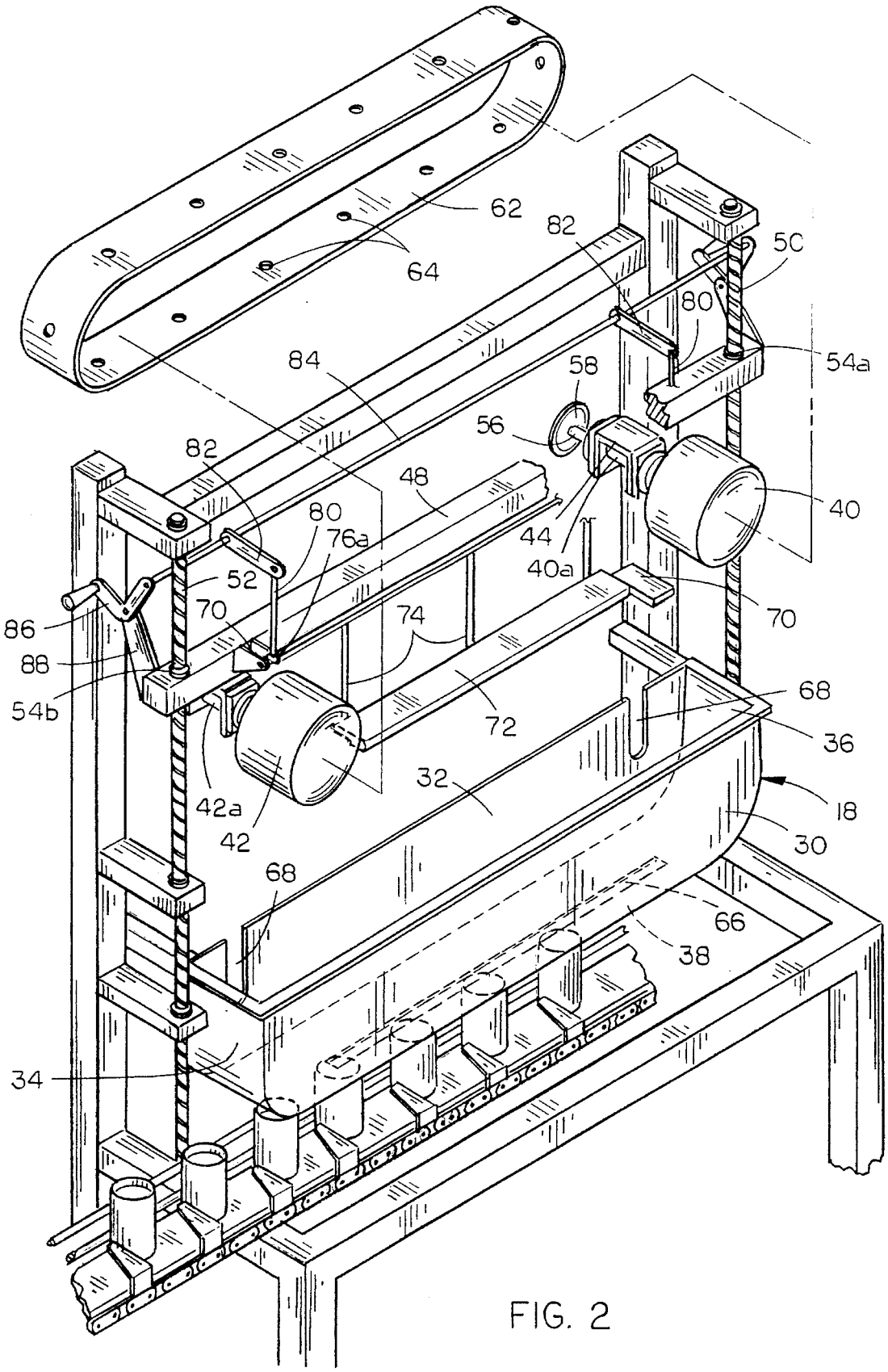
FIG. 2 is an exploded perspective view of the container filling system.

Referring now to FIG. 3, it can be seen that tank 18 is supported above conveyor 12 by a plurality of support arms 28 which cantilever outwardly from posts 24. Tank 18 includes forward and rearward vertical walls 30 and 32, left and right end walls 34 and 36 (as shown in FIG. 2) and a bottom 38. A cover (not shown) may be installed over the open upper end of tank 18, if so desired.

Referring now to FIG. 2, dispensing apparatus 16 includes a drive drum 40 and an idler drum 42, each rotatably mounted on a bearing 44 and 46 respectively. Bearings 44 and 46 are affixed to an elongated rigid bar 48 which is operably mounted at each end to parallel threaded shafts 50 and 52. As shown in FIG. 3, threaded shafts 50 and 52 are rotatably mounted parallel to posts 24 and spaced therefrom. Bar 48 includes a threaded aperture **54*a* and 54*b* at each end, engaged upon threaded shafts 50 and 52 respectively. Thus, rotation of shafts 50 and 52 will cause bar 48** to raise and lower thereon, as described in more detail hereinbelow.

Drive drum 40 includes a drive shaft 56 projecting rearwardly from bearing 44, with a sprocket 58 affixed thereto for engagement with a drive motor (not shown) via chain 60.

A continuous loop belt 62 extends around drums 40 and 42, and is driven by drive drum 40. Drive belt 62 includes a plurality of apertures 64 spaced uniformly apart along a center line down the center of belt 62. The spacing of apertures 64 is equal to the spacing of containers 14 on the conveyor 12 moved under dispensing apparatus 16, as shown in FIG. 3.

The bottom 38 of tank 18 has an elongated slot 66 formed therein along the center of the tank and extending slightly less than end to end in the tank. As shown in FIG. 3, slot 66 is aligned directly over conveyor 12 and containers 14 carried on conveyor 12. A pair of vertical slots 68 are formed in rearward wall 32 and extend from the upper end to a point approximately half way to the bottom of the tank. Slots 68 receive the axles 40*a* and 42*a* of drums 40 and 42, such that bearings 44 and 46 are mounted outside tank 18, as shown in FIG. 3.

Referring once again to FIG. 1, it can be seen that operation of dispensing apparatus 16 by rotating drums 40 and 42 will cause belt 62 to rotate therearound. Belt 62 is preferably formed of a material which is acceptable for food production and which forms a slidable seal with the tank bottom to prevent fluid leakage. In the drawings, the belt is shown of a flexible plastic material, although a stainless steel endless-type belt could also be used.

Drums 40 and 42 are preferably connected to the same drive system which operates conveyor 12, such that rotation of drums 40 and 42 coincides exactly with movement of conveyor 12. In this way, apertures 64 will move along at the same speed as containers 14, such that an aperture is always directly over a container. As the aperture passes over slot 66 in tank bottom 38, fluid within tank 18 will drop downwardly into an associated container 14. The product within tank 18 will continue to fill the associated container 14 until the aperture 64 reaches the opposing end of slot 66 adjacent right end wall 36. As shown in FIGS. 1 and 2, a panel 70 is mounted over the top of belt 62 and over the "downstream" end of slot 66, to prevent fluid from passing through an aperture in belt 62 under panel 70. This panel causes fluid flow to stop prior to reaching the downstream end of slot 66 to prevent liquid from contacting the downstream end of slot 66 and dripping.

Figure 4:
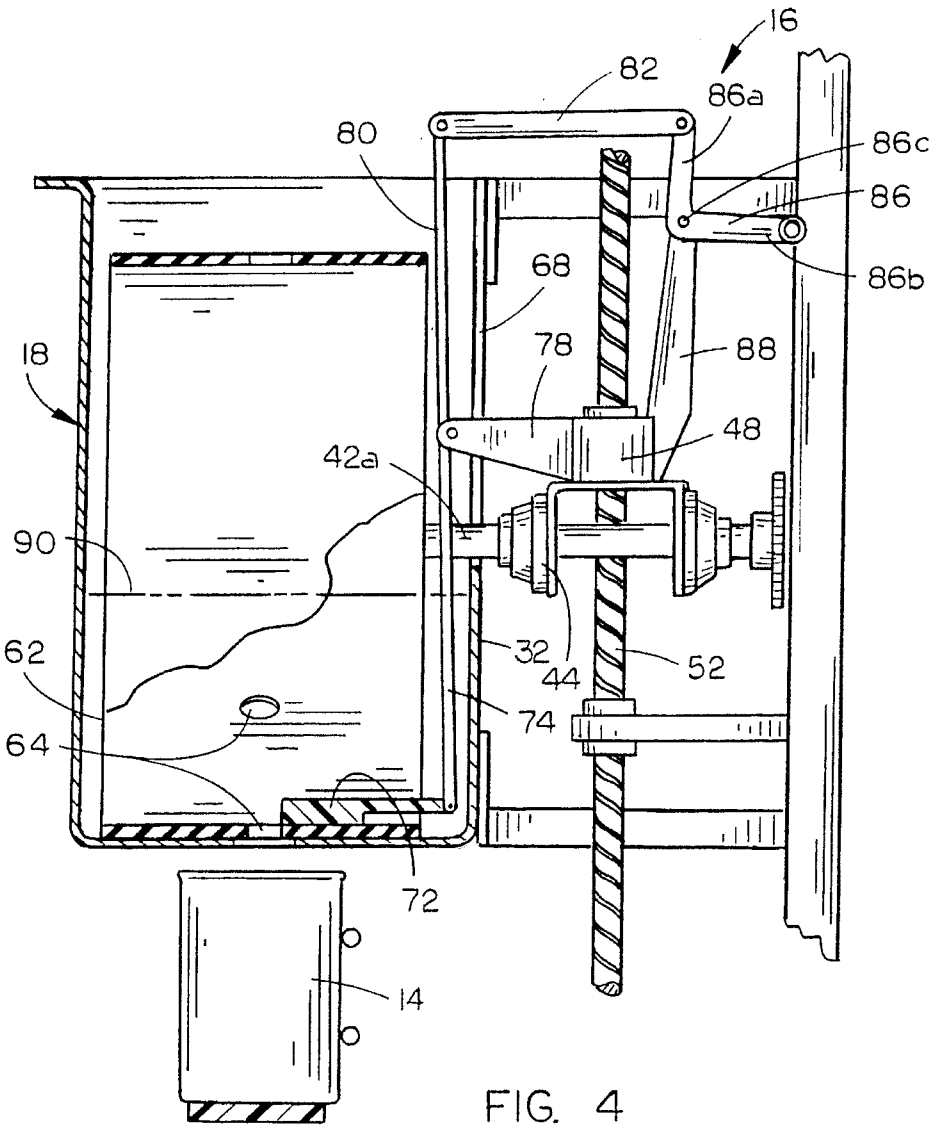
FIG. 4 is a sectional view similar to FIG. 3 showing the container filling system in an operating mode.

Referring again to FIGS. 2 and 3, a metering plate 72 is provided which extends the length of slot 66 in tank 18. Metering plate 72 slides over the top of apertures 64 in belt 62 in order to quickly and simply prevent the flow of product from tank 18 into containers 14. Plate 72 is preferably mounted for slidable movement within tank 18 to move from a "shut off" position covering apertures 64, as shown in FIG. 3, and an "open" position, as shown in FIG. 4, revealing apertures 64. It is also possible to shift plate 72 to partially cover apertures 64, if it is desired to reduce the amount of liquid flowing into containers 14. While the slidable movement of plate 72 may be accomplished in a number of ways, it is preferred that plate 72 be connected to the dispensing apparatus 16 rather than tank 18, in order to permit easy removal of dispensing apparatus 16 from tank 18, as shown in FIG. 5.

Referring to FIG. 2, metering plate 72 is supported on a plurality of vertical arms 74 depending from a horizontal rod 76 and rotatably connected at opposing ends 76*a* and 76*b* to projecting ears 78 on bar 48. A pair of upwardly projecting levers 80 are affixed to the ends of rod 76 and are pivotable to pivot rod 76 on its rotational axis on opposing pairs of ears 78. The upper ends of levers 80 are pivotally connected to a pair of links 82 which are pivotally connected to elongated rod 84, such that movement of rod 84 forwardly or rearwardly shifts links 82 to pivot levers 80.

As shown in FIG. 4, the rearward end of links 82 are connected to one leg 86*a* of L-shaped handle 86, which is pivotally connected to an upright 88 projecting upwardly from bar 48. Handle 86 includes a rearwardly projecting leg 86*b* and is pivotally connected at a pivot point 86*c*, as shown in FIG. 4. Movement of metering plate 72 from the open position shown in FIG. 4 to the closed position shown in FIG. 3 is accomplished by pivoting leg 86*b* of handle 86 to move link 82 rearwardly, thereby pivoting lever 80 and arms 74. The pivotal movement of arm 74 shifts plate 72 on belt 62 to cover or reveal apertures 64 in belt 62. Movement of metering plate 72 may also be operated pneumatically, to automatically adjust or shut off fluid dispensing.

Figure 5:
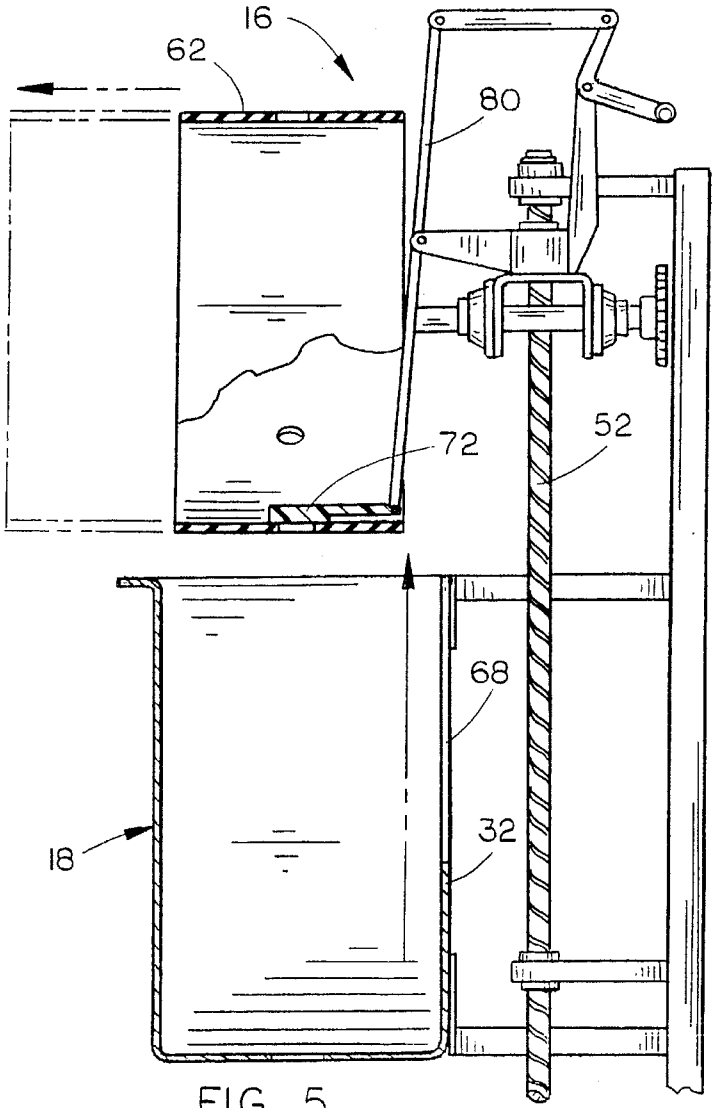
FIG. 5 is a view similar to FIG. 4, but with the dispenser apparatus removed from the dispensing tank.

Referring now to FIGS. 4 and 5, it can be seen that dispensing apparatus 16 may be lifted vertically out of tank 18 to permit quick and simple removal and replacement of belt 62. Rotation of threaded shafts 50 and 52 (either manually or motorized) will cause bar 48 to raise or lower, and thereby raise or lower dispensing apparatus 16. Slots 68 in the rearward wall 32 of tank 18 permit axles 40*a* and 42*a* to slide vertically out of tank 18 (also shown in FIG. 2). Replacement of belt 62 permits use of a belt with either diameter holes or differently spaced holes 64 to thereby provide a different rate of fluid flow, or a different spacing for various conveyors.

As shown in FIG. 4, dispensing apparatus 16 is lowered into tank 18 and the fluid level 90 within tank 18 is preferably maintained lower than the lower end of slots 68. This eliminates contact of axles 40*a* and 42*a* with the fluid contents of tank 18, and also prevents leakage of fluid through slots 68.

Figure 6:
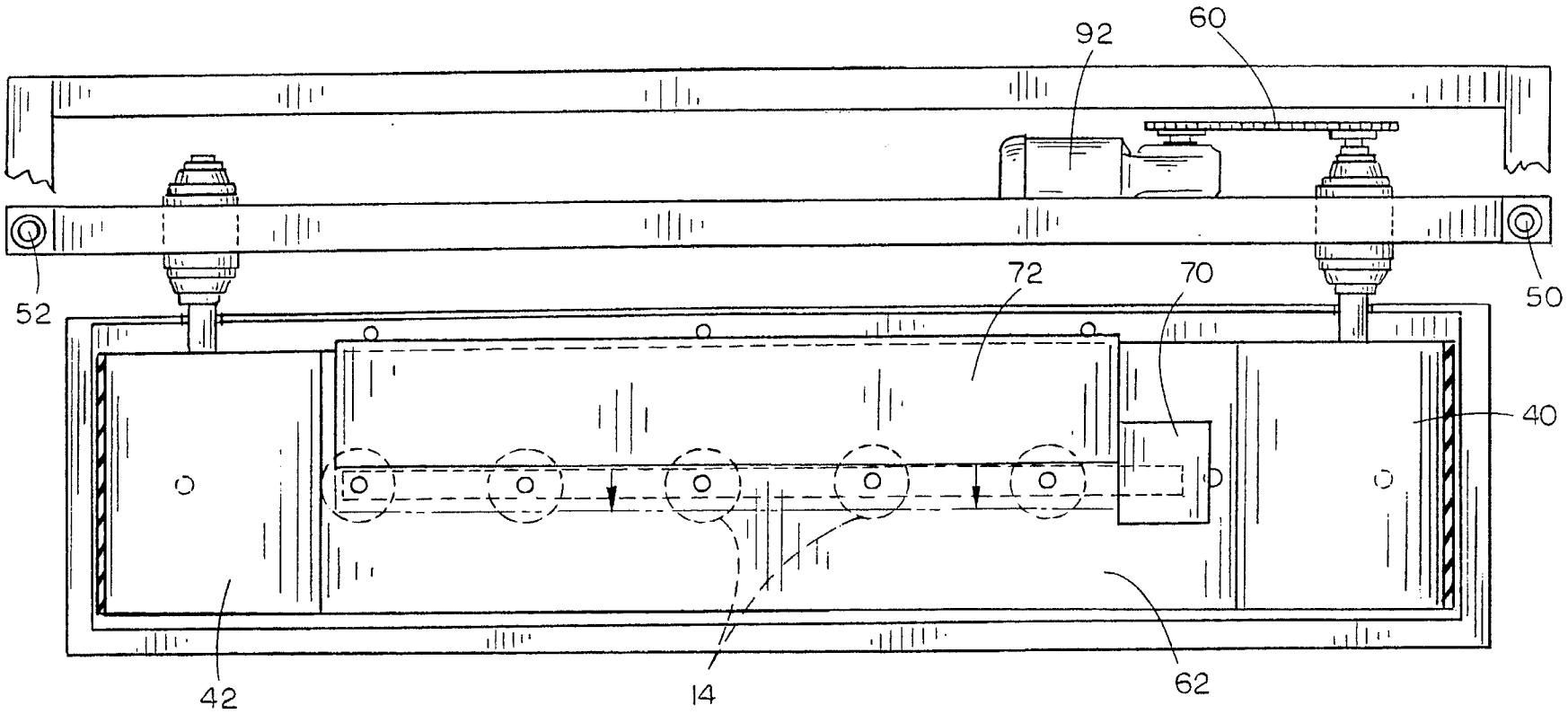
FIG. 6 is a top plan view of the container filling system.

Referring to FIG. 6, chain 60, which drives drive drum 40, is shown connected to a motor 92. Preferably, motor 92 is directly connected to the drive system for the conveyor, in order to maintain synchronized movement of belt 62 with container 14 on conveyor 12.

Whereas the invention has been shown and described in connection with the preferred embodiment thereof, many modifications, substitutions and additions may be made which are within the intended broad scope of the appended claims.

I claim:

1. An apparatus for filling a plurality of uniformly spaced apart containers moving along a conveyor, the conveyor being moved by a drive system, comprising:

an elongated tank having opposing forward and rearward longitudinal walls, left and right end walls, and a bottom;

an elongated slot formed in the tank bottom;

a continuous loop belt engaged around a pair of horizontally spaced apart rotatable drums for movement in a loop around the drums;

said belt having a width greater than the width of the slot and a length greater than the length of the slot;

said belt located in moving sealed and slidable engagement with the bottom of the tank to prevent leakage of fluid from the tank through the slot;

said belt having a plurality of uniformly spaced apart apertures formed along the belt and extending around the entire belt loop;

said belt apertures spaced a predetermined distance apart from one another to permit fluid to flow therethrough when the apertures are located over the slot; and means for driving the drums to slide the belt along the tank bottom.

2. The apparatus of claim 1, further comprising a metering plate operably mounted within said tank to move between a first position, completely covering the belt apertures located over the slot, and a second position, completely uncovering the belt apertures located over the slot, to selectively prevent fluid flow from the tank through the belt apertures over the slot.

3. The apparatus of claim 2, wherein said metering plate is adjustably mounted for selective movement between the first and second positions, to selectively cover less than the entirety of the belt apertures located over the slot.

4. The apparatus of claim 1, further comprising an anti-drip panel mounted in said tank in slidable sealed contact with an upper surface of the belt and located juxtaposed over a first end of the slot, to cover belt apertures approaching the first end of the slot prior to each aperture reaching the first end of the slot.

5. The apparatus of claim 1, wherein said tank is mounted over said conveyor and spaced above containers being moved on the conveyor, with the slot aligned over the containers moving under the tank, and wherein said belt apertures are spaced apart a distance equal to the distance between centers of the containers on the conveyor.

6. The apparatus of claim 5, wherein said means for driving the drums includes means operably interconnecting the conveyor drive system with the drums, to synchronize the speed of the moving containers with the speed of the belt sliding across the slot.

7. The apparatus of claim 1, wherein said belt and drums are removably and operably mounted in said tank, for movement between an operative position with the belt in sealed and slidable engagement with the tank bottom, and an inoperative position raised out of the tank.

* * * * *